US005740873A

United States Patent [19]

Tibbitts

[11] Patent Number: 5,740,873

[45] Date of Patent: Apr. 21, 1998

[54] ROTARY BIT WITH GAGELESS WAIST

[75] Inventor: Gordon A. Tibbitts, Salt Lake City, Utah

[73] Assignee: Baker Hughes Incorporated, Houston, Tex.

[21] Appl. No.: 550,092

[22] Filed: Oct. 27, 1995

[51] Int. Cl.[6] ..... E21B 10/26

[52] U.S. Cl. ..... 175/393

[58] Field of Search ..... 175/40, 343, 420.1, 175/426, 429

[56] References Cited

U.S. PATENT DOCUMENTS

| | | | |
|---|---|---|---|
| 2,614,809 | 10/1952 | Zublin . | |
| 3,915,246 | 10/1975 | Sheshtawy | 175/317 |
| 4,981,183 | 1/1991 | Tibbitts . | |
| 5,099,934 | 3/1992 | Barr . | |
| 5,199,511 | 4/1993 | Tibbitts et al. . | |
| 5,361,859 | 11/1994 | Tibbitts . | |
| 5,553,678 | 9/1996 | Barr et al. | 175/393 X |

FOREIGN PATENT DOCUMENTS

| | | |
|---|---|---|
| 0532869A1 | 7/1992 | European Pat. Off. . |
| 1348694 | 5/1971 | United Kingdom . |
| 2132252 | 10/1983 | United Kingdom . |

OTHER PUBLICATIONS

Corapcloglu, M. Yavuz and Abboud, Nelly M., Cake *Filtration with Particle Penetration at the Cake Surface*, SPE Reservoir Engineering, Aug. 1990, pp. 317–326.

*Primary Examiner*—William P. Neuder
*Attorney, Agent, or Firm*—Trask, Britt & Rossa

[57] ABSTRACT

A drill bit, process of drilling, and method of manufacturing the same are provided wherein the drill bit has a bit body defining a radially extending waist and a plurality of cutting elements proximate the waist. The waist has an outer diameter less than an outer diameter defined by a plurality of outermost cutting elements. The difference in outer diameters between the waist and the outermost cutting elements is determined by the thickness of filter cake that forms on the wall of a wellbore, such that the waist of the bit does not contact the filter cake during the drilling process.

25 Claims, 6 Drawing Sheets

ROTARY BIT WITH GAGELESS WAIST

BACKGROUND OF THE INVENTION

1. Field of the Invention

This invention relates generally to rotary-type drill bits for drilling into subterranean earth formations including geothermal formations, water wells and hydrocarbon producing formations and, more particularly, to drill bits having a waist located above a plurality of cutting elements wherein the diameter of the waist is less than the diameter formed by an outer periphery of cutting elements such that filter cake forming on the wall of a borehole during the drilling process is not disturbed by the waist and fluid loss to the formation is significantly reduced.

2. State of the Art

The equipment used in drilling operations is well known in the art and generally includes a drill bit attached to a drill stem, including a kelly, drill pipe, and drill collars. A rotary table or other device such as a top drive is used to rotate the drill pipe, resulting in a corresponding rotation of the drill bit. Drill collars, which are heavier than drill pipe, are normally used on the bottom part of the drill string to put weight on the drill bit. The weight of these drill collars presses the drill bit against the formation being drilled at the bottom of the borehole, and causes it to drill when rotated.

The drill bit itself generally includes a bit body, with a connecting structure for connecting the bit body to the drill string, such as a threaded portion, and a cutting structure for cutting into an earth formation. Generally, if the bit, is a fixed-cutter or so-called "drag" bit the cutting structure includes a series of cutting elements made of a super-hard substance, such as polycrystalline diamond, oriented on the bit face at an angle to the surface being cut. The radially outermost cutting elements are referred to as gage cutters, which typically have a flattened outer profile to cut a precise gage diameter through the borehole. In a typical bit arrangement, the gage of the bit is located adjacent and above the gage cutters and radially extends longitudinally along the bit body at a given radius from the bit centerline. In a slick gage arrangement, the radius of the gage is essentially the same as the gage cutters.

Various manufacturing techniques known in the art are utilized for making such a drill bit. In general, the bit body may be formed from a tungsten carbide matrix cast onto a blank which is welded to a tubular shank. Threads are formed onto the free end of the shank to correspondingly match the threads of a drill collar. Cutting elements made of natural diamond or synthetic polycrystalline diamond are then attached to the other end of the bit body by brazing or other techniques known in the art. Cast steel body bits as well as bits with machined steel bodies are also known in the art.

In a hydrocarbon producing formation, the formation is composed of both solid material and hydrocarbons. The hydrocarbons are located in pores in the formation through which a drill bit may pass. The pores extend from the borehole wall out into the formation, and pores may intersect one another at a pore throat away from the borehole wall.

Once the drill bit begins to cut through a formation and the positive pressure differential between the formation and the drilling mud in the borehole is established, over time, a substance known as filter cake forms on the wall of the borehole. The filter cake is composed of a layer of concentrated solids from the drilling mud and fine particles generated from the drilling process. Eventually, the filter cake forms a barrier between the wellbore and the producing formation such that the fluid phase of the drilling mud and associated fines are restricted from penetrating into the pores of the producing formation.

In a slick gage arrangement, as the gage of the drill bit passes the filter cake, the filter cake may be compressed and forced to a higher degree into the pores of the wellbore, effectively reducing the permeability of the producing formation. Similarly, the passage of the gage through the filter cake may actually destroy the filter cake. If the filter cake is disturbed or destroyed during the drilling process, spurt loss may occur where the drilling mud and associated fines are allowed to penetrate deeper into the pores of the formation to create a damaged zone. These particles become lodged and further obstruct the pore throats of the formation. The well then becomes particularly difficult to produce.

Once the borehole has been drilled, the wellbore may have to be treated in some way to allow production of hydrocarbons or other substances through any damaged zones in the wall of the wellbore created during the drilling process. One method of treatment is known as acidizing, whereby acid is injected into the wellbore. In formations made of limestone or dolomite, the acid dissolves the formation through the damaged zone, effectively etching channels into the wall of the wellbore. Hydrocarbons from the formation can then enter the wellbore through these channels.

Perforating is another technique used to allow hydrocarbons from the formation to flow into the wellbore and enhance the available surface area for producing the formation. Perforating involves the use of shaped charges that penetrate the formation with a jet of high-pressure, high-velocity gas generated when the charge is detonated. The holes made by the charges extend some distance into the formation and allow oil or gas to enter the wellbore through these perforations.

Fracturing is another approach used to make a well produce. In fracturing, particles of a desired composition and size, termed "proppants," are pumped in a fluid suspension into the borehole at high pressures. The pressure of the fluid is sufficient to literally fracture the formation. The proppants enter the fractures and hold the fractures open once the fluid pressure is dropped.

Depending on the amount of damage to the wellbore, additional or more extensive treatment may be required to get the formation to produce commercially viable volumes of hydrocarbons. In any event, the methods of treatment are extremely expensive. Thus, it is highly desirable to keep such processes to a minimum. Moreover, the damaged zones may extend beyond the effective treatment depth. In such a case, the well may be untreatable and abandoned for lack of production. This untreatable condition, however, may not be known until millions of dollars have been spent on various treatment methods.

One device used to drill through producing formations is disclosed in U.S. Pat. No. 5,199,511 to Tibbitts et al. In this patent, a drill bit is disclosed, wherein drilling fluid is circulated through internal channels in the drill bit to collect cuttings from the cutting face. Such a drill bit isolates the drilling fluid from the space between the gage of the bit and the filter cake.

In U.S. Pat. No. 5,361,859 to Tibbitts, a drill bit having movable cutting members is disclosed. When the cutting member is forced into contact with the bottom of the borehole, the cutting members slide to a position in which the diameter defined by the cutting members is greater than the diameter of the drill bit body.

FIG. 6 of the drawings shows a prior art bit with a flush gage ground to a specified diameter slightly less than (0.050–0.060 in.) the outer diameter of the gage cutters. As shown, the filter cake F is compressed into a very thin layer and into the wall of the borehole by the gage of the prior art bit. The dashed line of FIG. 6 represents the formation of filter cake F' which would build if undisturbed by the gage of the bit.

The aforementioned references, however, do not address the necessary difference between the diameter of the waist and the outer diameter of the gage cutters in relation to the thickness of filter cake. Moreover, the prior art does not ensure that the filter cake is not disturbed by the waist of the bit once the gage cutters of the drill bit cut the formation. Thus, it would be desirable to provide a drill bit with a predetermined waist diameter so that the filter cake is not disturbed by the waist of the bit during the drilling process.

SUMMARY OF THE INVENTION

The present invention provides a process and drill bit for drilling a borehole into a subterranean formation, and method of manufacturing the same, in which the diameter of the waist of the drill bit is reduced in size so that filter cake may form on the wall of a borehole during the drilling process without being impinged or impeded by the waist. The drill bit is generally comprised of a bit body, a connecting structure to connect the drill bit to a drill string, and at least one cutting structure for cutting into an earth formation. The connecting structure may be an externally or internally threaded connector or any other type of connector known in the art. The cutting structure is typically comprised of a plurality of cutting elements and may include a series of gage cutters. Between the cutting structure and the connecting structure is the waist of the drill bit, extending longitudinally from the gage cutters along a length of the bit body.

The waste has a diameter that is less than the diameter formed by the outer periphery of cutting elements or gage cutters, and is thus recessed behind the cutting elements when looking at the bit face along the bit centerline or axis. The dimension of the diameter of the waist is a function of the thickness of filter cake that will form on the wall of the borehole during the drilling process. Thus, the diameter of the waist relative to the diameter of the cutting structure is such that the waist can pass through the wellbore and the filter cake formed on the wall thereof without damaging or destroying the filter cake.

The thickness of filter cake that forms in a wellbore may be predicted in several ways, including mathematical modelling or controlled laboratory testing to simulate drilling a wellbore in a producing formation. Typically, the filter cake thickness is in the range of 0.06 inches or more. In mathematical terms, the dynamic filtration rate may be calculated using Darcy's Law. Accordingly, the flow (Q) of the filtrate into the formation is dependent upon the area (A) through which the filtrate is flowing, the permeability (k), the viscosity of the filtrate ($\mu_L$), and the pressure gradient over a length of the borehole ($\Delta P/\Delta L$). Thus, $$Q/A=k/\mu_L(\Delta P/\Delta L).$$

Using this equation, the thickness (d) may be calculated knowing the filtrate volume ($\Delta V$), the time interval ($\Delta t$), the temperature (for the temperature dependent constant, K), the viscosity of the liquid filtrate ($\mu_L$), the shear stress ($\tau$), the filter cake compressibility ($-v+1$), and the friction between solids (f). The approximate filter cake thickness (d) is thus calculated as:

$$d=[K\Delta t(\tau/f)^{(-v+1)}]/[\Delta V\mu_L(-v+1)]$$

The filter cake thickness may also be simulated by pressurizing a rock specimen in a laboratory. The specimen is then drilled with a small bit under conditions similar to those found on a drilling site. The laboratory conditions may be altered to simulate various formations, resulting in a range of filter cake thicknesses dependent upon the aforementioned factors.

Once formed, the filter cake should not be affected or disturbed by the waist of the bit either by having the waist diameter greater than the bore diameter defined by the inside or borehole side of the filter cake, or by forcing drilling fluid into the formation by the waist. Thus, the present invention provides a drill bit such that drilling fluid may be circulated without damaging or penetrating the filter cake. In a more particular aspect of the invention, the drill bit is formed with at least one internal passage to direct drilling fluid from the drill string, through the bit body, to a location near the face of the bit to collect formation cuttings on the bit interior, and out of the bit at a location above the gage of the bit. This prevents drilling mud from being forced into the filter cake at the location of the waist.

In another more particular aspect of the invention, the drill bit is formed with at least one internal passage to direct drilling fluid from the drill string, through the bit body, and out to the cutting elements through nozzles, a crow's foot or other openings in the bit face. The waist is again substantially reduced in size and may be provided with large external channels of a size and configuration to adequately allow the drilling mud to freely pass between the filter cake and the waist of the bit body.

Like the diameter of the waist, the profile of the bit is also very important. With a low invasion profile such as is disclosed in the aforementioned Tibbitts '511 patent, any damage to the formation caused by filtration fluid flow is cut away by the drill bit. Thus, the present invention provides a bit with a low invasion profile that directs the filter flux toward the bottom of the borehole, rather than toward the side wall of the borehole, as with conventional bits.

The present invention overcomes disadvantages found in the art associated with drilling producing formations. That is, the filter cake is allowed to form on the wall of the borehole with little or no disturbance from the bit body or drilling fluid. Drilling fluid is routed away from the filter cake at the location of the waist above the gage cutting elements, or allowed to freely pass at relatively low velocities between the waist and the filter cake.

Other advantages provided by a reduced waist include increased rate of penetration because of reduced frictional forces, ease of steerability of the bit, more accurate log data, and ease of manufacturing because the waist does not need to be ground to a precise diameter.

The foregoing and other objects, features and advantages of the invention will become more readily apparent from the following detailed description of the preferred embodiments which proceeds with reference to the drawings.

DETAILED DESCRIPTION OF THE ILLUSTRATED EMBODIMENTS

Figure 1:
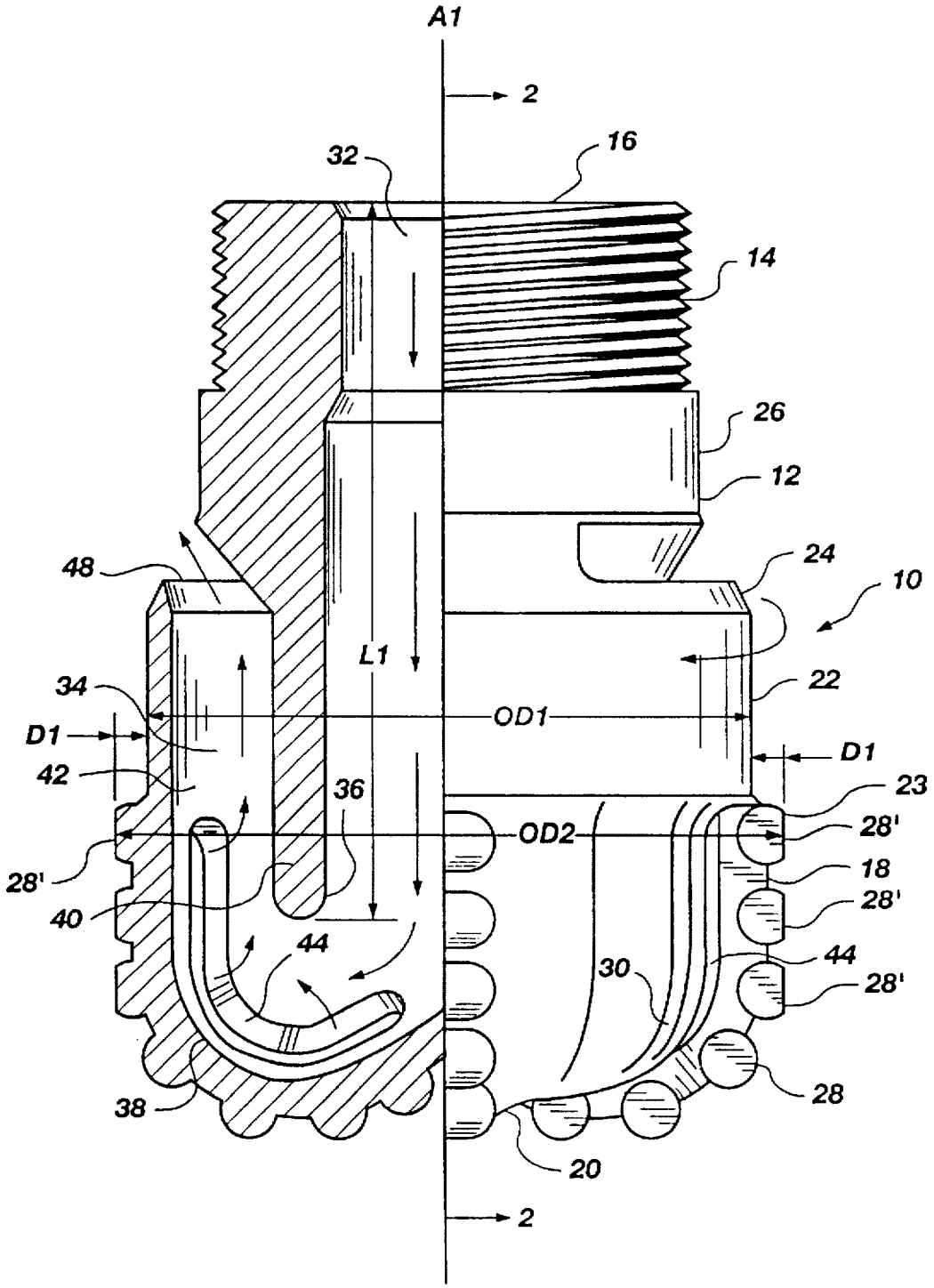
FIG. 1 is a partial sectional view of a drill bit constructed in accordance with the present invention.

As shown in FIG. 1, the drill bit 10 is comprised of a bit body 12 having a threaded connector 14 at its proximal end 16 and a cutting face 18 at its distal end 20. Adjacent the cutting face 18, the bit has a waist 22 with an outer diameter OD1 longitudinally extending from the cutting face 18 to a frustoconical portion 24. The frustoconical portion 24 extends radially inwardly and longitudinally upwardly from the waist 22 to a cylindrical portion 26. The cylindrical portion 26 longitudinally extends from the frustoconical portion 24 to the threaded connector 14.

The cutting face 18 has a curved surface 30 radially extending from the waist 22 to the distal end 20. A plurality of cutting elements 28 is attached to the curved surface 30 at the cutting face 18. A portion of the curing elements 28, including a plurality of gage cutters 28', extend beyond the cutting face 18. An outer diameter OD2 is formed by the gage cutters 28' and exceeds the outer diameter OD1 by an amount twice the distance D1 radially extending from the waist 22 to the outer edge 23 of the gage cutter 28'.

As can be seen in FIG. 1, the drill bit 10 has an internal bore 32 extending from the proximal end 16 a length L1 into the bit body 12. An internal passage 34 is connected to and is in fluid contact with the bore 32 at its distal end 36. The passage 34 is formed between an internal surface 38 of the face 18 and a portion 40 defining a wall 42 of the bore 32. The internal surface 38 follows the contour of the face 18, and extends through the waist 22 to an exit 48 at a location above the waist 22.

As shown by arrows, at the location of the cutting elements 28, the passage 34 has an opening 44 that allows cuttings produced during drilling to flow from the cutting elements 28 through the cutting face 18 and into the passage 34. The mixture of drilling fluid and cuttings (drilling mud) flows back up through the passage 34 and out the exit 48. Thus, the drilling mud enters the annular space 50 (see FIG. 2) created between the drill string (not shown) and the filter cake 52 at the exit 48.

Figure 2:
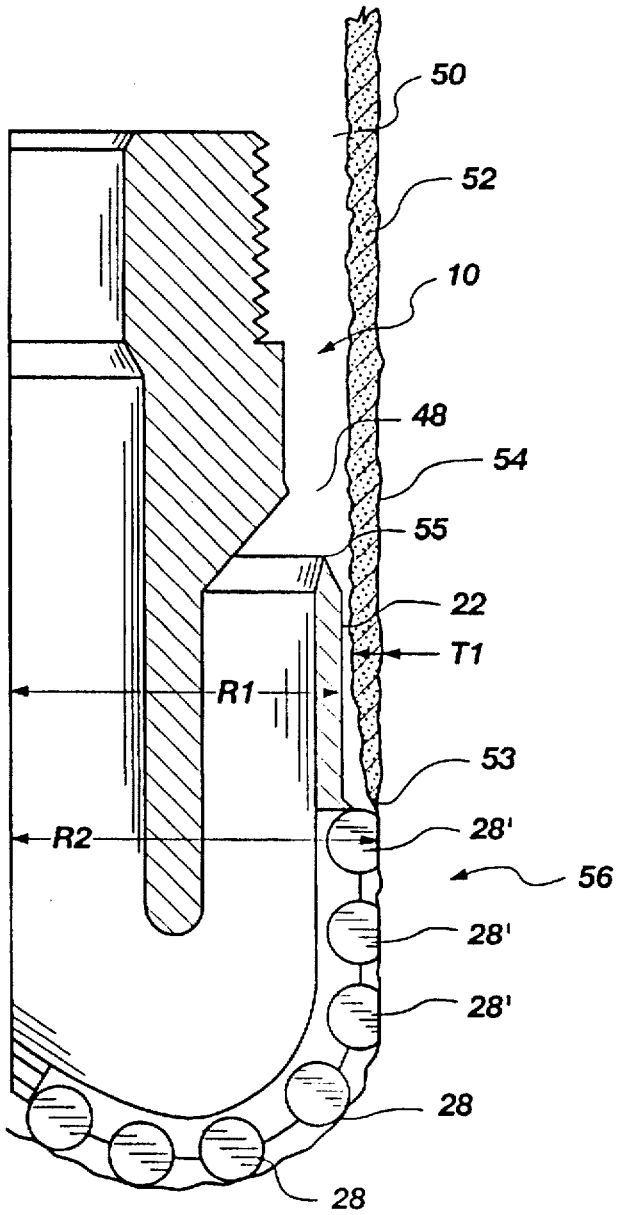
FIG. 2 is a sectional view of a portion of the drill bit shown in FIG. 1.

FIG. 2 is a sectional view of Section A—A of the embodiment shown in FIG. 1 and illustrates the orientation of the drill bit 10 in relation to the wellbore 54 and the filter cake 52. As the drill bit 10 rotates into the producing formation 56 and cuts the wellbore 54, a layer of filter cake 52 forms almost instantaneously at a point 53 adjacent to the gage cutter 28'. To keep the drill bit 10 from disturbing the filter cake 52 once cut by the plurality of cutting elements 28, the outer diameter OD1 (twice R1) of the waist 22 is formed to be less, and preferably substantially less, than the outer diameter OD2 (twice R2) of the gage cutters 28' by an amount greater than or equal to twice the thickness T1 of the filter cake 52. As previously mentioned, the thickness T1 of the filter cake 52 is equal to $[K\Delta t(\tau/f)^{(-\nu+1)}]/[\Delta V\mu_L(-v+1)]$. Moreover, as can be seen in FIG. 2, the exit 48 is at a location 55 above the waist 22 such that drilling fluid exiting the exit 48 is not forced between the waist 22 and the filter cake 52.

Figure 3:
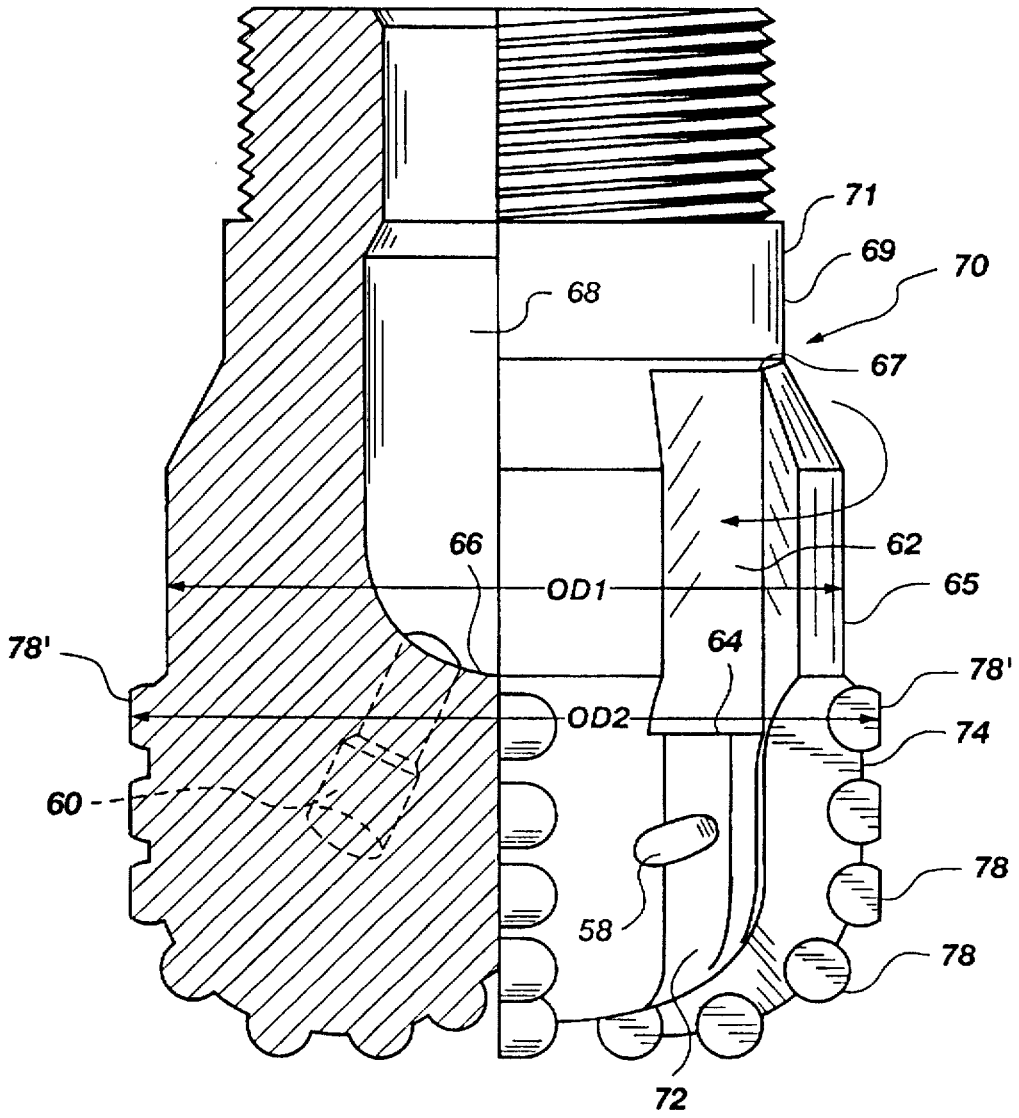
FIG. 3 is a partial sectional view of an alternate embodiment of a drill bit constructed in accordance with the present invention.

FIG. 3 shows another preferred embodiment substantially similar to the embodiment disclosed in FIG. 1, in that the outer diameter OD1 of the waist 65 is less than the outer diameter OD2 of the gage cutters 78' by an amount equal to or more than twice the thickness T1 of filter cake 52. The drill bit 70 of FIG. 3, however, has a nozzle port 58 at the outer end of an internal bore 60 extending from the distal end 66 of plenum 68 to a curved bit face 72. Blades 74, carrying cutters 78 and 78', protrude from face 72.

Moreover, the waist 65 has a longitudinal channel or junk slot 62 formed therein extending from a proximal end 64 of the curved bit face 72 to a point 67 near or into the cylindrical portion 69. The junk slot 62 reduces the velocity of the fluid flow. As such, the filter cake 52 will be minimally disturbed by fluid washing (i.e., dynamic filtration).

As drilling fluid is circulated through the plenum bore 68, through the internal bore 60 and out through the nozzle port 58, the space between the bit face 72 and blades 74 allows the drilling fluid to circulate to the cutters 78. The drilling mud then circulates through the junk slot 62 and out to the annular space 50 so that the drilling fluid is not forced into the filter cake 52.

Figure 4:
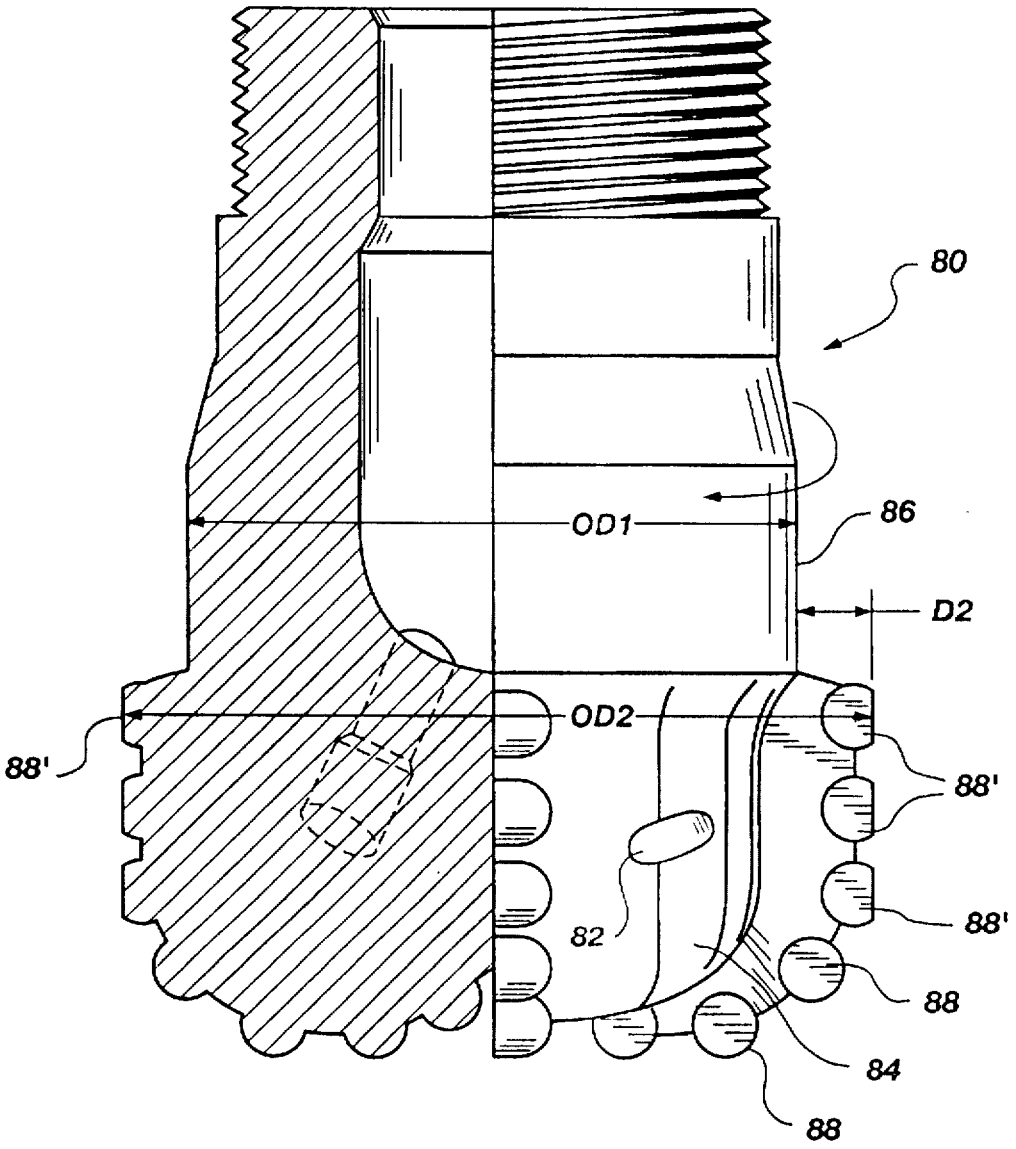
FIG. 4 is a partial sectional view of another preferred embodiment of a drill bit constructed in accordance with the present invention.

Likewise, the drill bit 80 shown in FIG. 4 has a nozzle port 82 and a recessed curved portion 84 to allow circulation of drilling fluid to the cutting elements 88. However, the outer diameter OD1 of the waist 86 is less than the outer diameter OD2 formed by the gage cutters 88' by a distance 2×D2, which is at least equal to twice the thickness T1 of filter cake 52 plus an amount sufficient to allow the drilling fluid to freely flow past the filter cake 52 at relatively low velocities such that the drilling fluid is not forced into or through the filter cake 52, or disturb the surface thereof.

Figure 5:
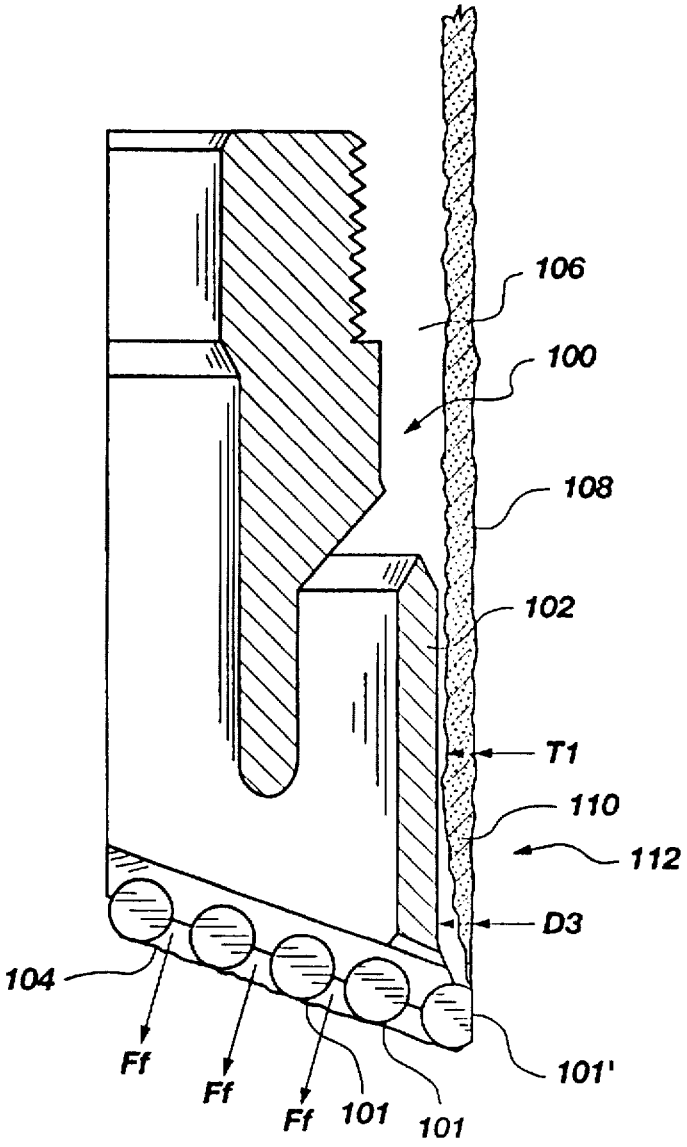
FIG. 5 is a partial sectional view of another preferred embodiment of a drill bit having a low invasion profile constructed in accordance with the present invention.
Figure 6:
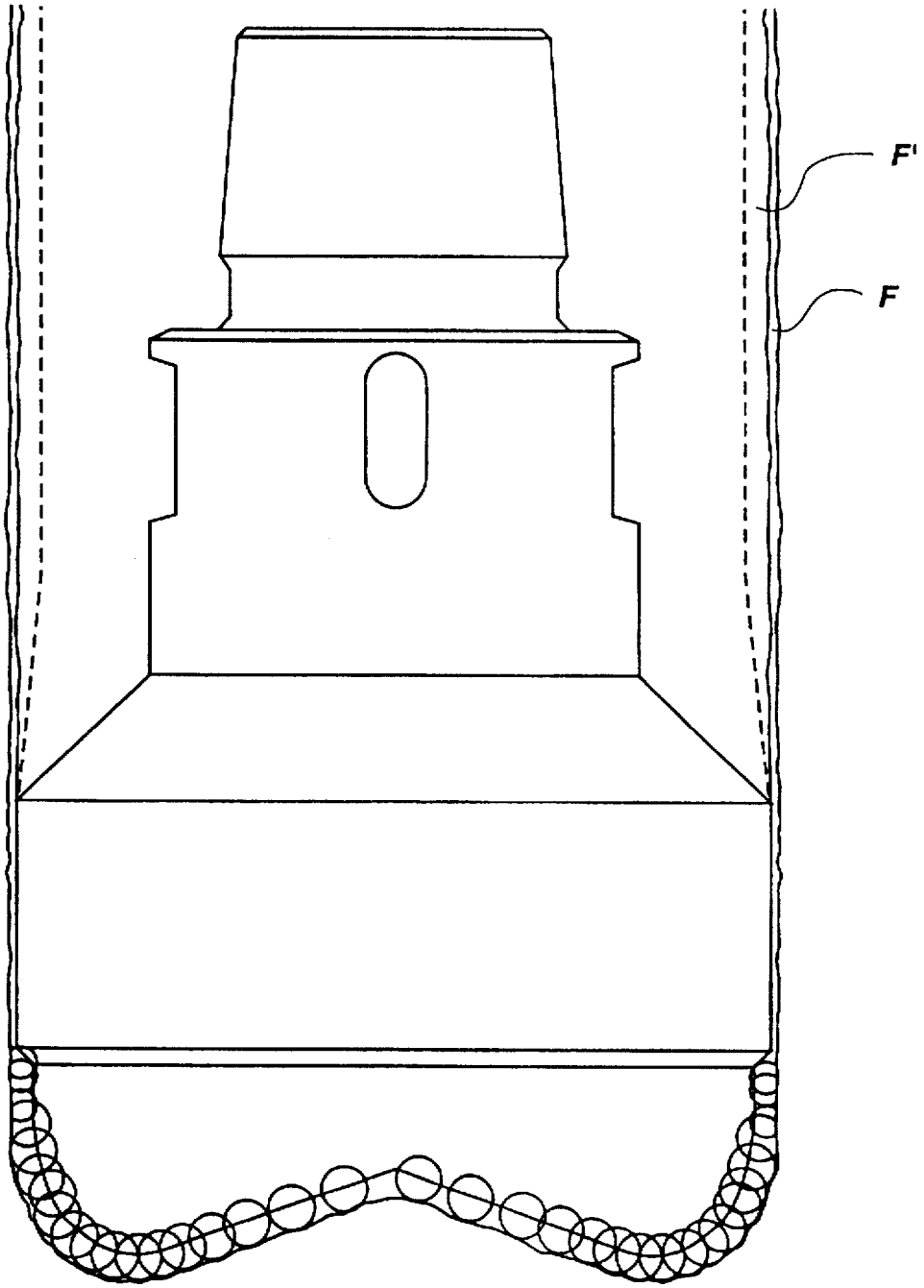
Fig. 6 (PRIOR ART)
FIG. 6 is a side portion schematic elevation of a prior art drill bit in a borehole depicting the profile and cutting element placement, a gage area of slightly reduced diameter, and filter cake formation.

Finally, as can be seen in FIG. 5, a sectional view of a low invasion profile bit 100 is shown. The bit 100 has one or more gage cutters 101' that extend a distance D3 beyond the waist 102. As shown by arrows, the fluid flow $F_F$ is directed downwardly and radially inwardly toward the bottom 104 of the wellbore 106. This prevents the drilling fluid from being directed into the wall 108 of the wellbore 106. Thus, as the bit 100 is rotated into the formation 112, the cutters 101 remove the formation 112 damaged by drilling fluid. Moreover, as with the other embodiments herein described, the reduced size of the waist 102 allows the filter cake 110 to form on the wall 108 of the wellbore 106 without being disturbed by the waist 102.

Reference herein to specific details of the illustrated embodiment is by way of example and not by way of limitation. It will be apparent to those skilled in the art that many modifications of the basic illustrated embodiment may be made without departing from the spirit and scope of the invention as recited by the claims.

What is claimed is:

1. A rotary drill bit for drilling subterranean formations, comprising:

a bit body having a distal end including a face, a proximal end, a longitudinal axis and a waist defining a first outer diameter located longitudinally proximal of said face and extending toward said proximal end, said bit body defining no greater diameter than said waist proximally therefrom;

a connecting structure positioned at said proximal end of said bit body for connecting said bit body to a drill string;

an internal passage defined by said bit body for circulating drilling fluid from said drill string, into said bit body, adjacent said face and in communication therewith, and out of said drill bit at a location proximal of said waist; and cutting structure fixedly mounted on said face at said distal end of said bit body for cutting a subterranean formation, said cutting structure positioned distally of said waist, extending radially outwardly past said waist, and defining a second outer diameter substantially greater than said first outer diameter, said radially extending cutting structure comprising a last contact area between said drill bit and a subterranean formation being drilled by said drill bit.

2. The drill bit of claim 1 wherein said second outer diameter is at least 0.12 inches greater than said first outer diameter.

3. The drill bit of claim 1 wherein said cutting structure comprises a plurality of cutting elements.

4. The drill bit of claim 3 wherein said plurality of cutting elements includes a plurality of gage cutters distal of said waist, said gage cutters defining said second outer diameter greater than said first outer diameter defined by said waist.

5. The drill bit of claim 1 wherein said connecting structure comprises a threaded portion.

6. A method for drilling subterranean formations, comprising:

attaching a drill bit having a cutting structure thereon, at least a portion of said cutting structure defining a gage diameter, to an end of a drill string;

lowering said drill string and said drill bit into an earth formation;

rotating said drill string;

drilling a borehole having a sidewall of said gage diameter; and maintaining all portions of said drill bit above said cutting structure portion out of contact with said sidewall of said borehole by a substantial distance at least greater than a predicted depth of filter cake on said sidewall.

7. The method of claim 6 wherein said method further includes predicting a depth of said filter cake.

8. The method of claim 7 wherein predicting said depth of said filter cake includes calculating filter cake thickness from at least one of the following: flow of filtrate into the formation, an area through which the filtrate is flowing, formation permeability, filtrate viscosity, a pressure gradient over a length of a borehole, filtrate volume, a time interval, temperature, shear stress, filter cake compressibility, and friction between solids.

9. The method of claim 8 wherein said method further includes selecting a drill bit configuration that keeps said drill bit from further contacting said filter cake after passage of said cutting structure through said borehole.

10. The method of claim 6 wherein said method further includes circulating drilling fluid through said drill bit.

11. The method of claim 10 wherein said method further includes selecting said drill bit wherein said drill bit functions at lower than normal flow velocities of drilling fluid.

12. The method of claim 11 wherein said method further includes selecting a drill bit configuration that allows said drilling fluid to freely circulate between said drill bit and filter cake without substantial disturbance to the latter.

13. The method of claim 10 wherein said method further includes selecting said drill bit, said step of selecting being based on a drill bit that reduces an amount of said drilling fluid that circulates between a waist of said drill bit and filter cake.

14. A method of manufacturing a rotary drill bit for drilling subterranean formations comprising:

forming a bit body having a distal end including a face, a proximal end, a longitudinal axis, a waist defining a first outer diameter extending longitudinally proximal of said face and extending toward said proximal end, at least one internal passage into said bit body extending from said proximal end through said bit body in communication with said face to an exit location proximal of said waist, and a connecting structure positioned proximate said proximal end of said bit body for connecting said bit body to a drill stem; and fixedly mounting a cutting structure on said face, said cutting structure positioned distally of said waist, extending radially outwardly past said waist, and defining a second outer diameter substantially greater than said first outer diameter of said waist of said bit body, said radially extending cutting structure comprising a last contact area between said drill bit and a subterranean formation being drilled by said drill bit.

15. A process for drilling an earth formation comprising:

selecting a drill bit, said drill bit having a bit body, a connecting structure at a proximal end thereof for connecting said drill bit to a drill string, a cutting structure fixedly mounted at a distal end of said bit body for cutting an earth formation, and a waist positioned between said distal and proximal ends, wherein said selecting is in part based on a predicted thickness of filter cake that deposits on a sidewall of a borehole during the drilling process such that said cutting structure defines an outer diameter greater than an outer diameter of said waist, the difference between said outer diameter defined by said cutting structure and said outer diameter of said waist being at least equal to twice said predicted thickness of filter cake;

attaching said drill bit to said drill string;

lowering said drill string and said drill bit into said earth formation;

rotating said drill string; and drilling said borehole into said earth formation.

16. The process of claim 15 wherein said process further includes circulating drilling fluid through said drill bit and within said drill bit in communication with formation material being cut by said cutting structure, and into an annular space formed between said borehole sidewall and said drill bit at a location above said waist.

17. The process of claim 15 wherein said process further includes circulating drilling fluid through said drill bit, out of said distal end to said cutting structure, past said cutting structure, past said waist, and into an annular space formed between said borehole sidewall and said drill string such that said drilling fluid is allowed to freely pass between said waist and a filter cake formed on said borehole sidewall.

18. The process of claim 15 wherein said process further includes selecting said drill bit based on a pressure differential between a formation and drilling fluid in said borehole.

19. The process of claim 15 wherein said process further includes predicting said thickness of filter cake.

20. A rotary drill bit for drilling subterranean formations, comprising:

a bit body having a distal end including a face, a proximal end, an internal passage extending from said proximal end into said bit body to said face and exiting thereon, a longitudinal axis and a waist defining a first outer diameter located longitudinally proximal of said face and extending toward said proximal end, said waist defining a channel thereon extending from said face to a location on said bit body proximal of said waist, said bit body defining no greater diameter than said waist proximally therefrom;

a connecting structure positioned at said proximal end of said bit body for connecting said bit body to a drill string; and cutting structure fixedly mounted on said face at said distal end of said bit body for cutting a subterranean formation, said cutting structure positioned distally of said waist, extending radially outwardly past said waist, and defining a second outer diameter substantially greater than said first outer diameter, said radially extending cutting structure comprising a last contact area between said drill bit and a subterranean formation being drilled by said drill bit.

21. A rotary drill bit for drilling subterranean formations, comprising:

a bit body having a distal end including a face, a proximal end, a longitudinal axis and a waist defining a first outer diameter located proximal of said face and extending toward said proximal end, said bit body defining no greater diameter than said waist proximally therefrom, said bit body further including an internal passage extending a distance from said proximal end into said bit body and through said bit body to an exit proximal of said waist;

a connecting structure positioned at said proximal end of said bit body for connecting said bit body to a drill string; and cutting structure fixedly mounted on said face at said distal end of said bit body for cutting a subterranean formation, said cutting structure positioned distally of said waist, extending radially outwardly past said waist, and defining a second outer diameter substantially greater than said first outer diameter, said radially extending cutting structure comprising a last contact area between said drill bit and a subterranean formation being drilled by said drill bit.

22. A rotary drill bit for drilling subterranean formations, comprising:

a bit body having a distal end including a face, a proximal end, a longitudinal axis and a waist defining a first outer diameter located longitudinally proximal of said face and extending toward said proximal end, said bit body defining no greater diameter than said waist proximally therefrom;

a connecting structure positioned at said proximal end of said bit body for connecting said bit body to a drill string; and cutting structure fixedly mounted on said face at said distal end of said bit body for cutting a subterranean formation, said cutting structure positioned distally of said waist, extending radially outwardly past said waist, and defining a second outer diameter substantially greater than said first outer diameter, said radially extending cutting structure comprising the last contact area between said drill bit and a subterranean formation being drilled by said drill bit;

wherein a difference between said first and second outer diameters is at least equal to twice a predicted thickness of filter cake and at least sufficient to allow a predicted volume of drilling fluid at a predicted velocity to pass between said first outer diameter and the predicted thickness of filter cake without substantial disturbance to the filter cake.

23. A method of manufacturing a rotary drill bit for drilling subterranean formations comprising:

forming a bit body having a distal end including a face, a proximal end, a longitudinal axis, a waist defining a first outer diameter extending longitudinally proximal of said face and extending toward said proximal end, at least one internal passage into said bit body extending from said proximal end through said bit body to said face and exiting thereon, a channel on said waist extending from said face to a location on said bit body proximal of said waist, and a connecting structure positioned proximate said proximal end of said bit body for connecting said bit body to a drill stem; and fixedly mounting a cutting structure on said face, said cutting structure positioned distally of said waist, extending radially outwardly past said waist, and defining a second outer diameter substantially greater than said first outer diameter of said waist of said bit body, said radially extending cutting structure comprising a last contact area between said drill bit and a subterranean formation being drilled by said drill bit.

24. The method of claim 23 wherein said channel comprises sufficient cross-sectional area to reduce flow velocity of drilling fluid above said cutting structure and exterior to said bit body during a drilling operation.

25. The method of claim 23 further including sizing said waist to reduce velocity of drilling fluid circulating between said bit body and a borehole to a desired degree.

* * * * *